US008177539B2

(12) United States Patent
Groner-Rothermel et al.

(10) Patent No.: US 8,177,539 B2
(45) Date of Patent: May 15, 2012

(54) DEVICE FOR MELT SPINNING MULTICOMPONENT FIBERS

(75) Inventors: Mathias Groner-Rothermel, Neumunster (DE); Volker Birkholz, Neumunster (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 12/880,783

(22) Filed: Sep. 13, 2010

(65) Prior Publication Data

US 2011/0059196 A1 Mar. 10, 2011

Related U.S. Application Data

(63) Continuation of application No. PCT/EP2008/055649, filed on May 7, 1008.

(30) Foreign Application Priority Data

Mar. 14, 2008 (DE) ..... 10 2008 014 361

(51) Int. Cl.
*D01D 5/30* (2006.01)
*D01D 4/06* (2006.01)

(52) U.S. Cl. ..... 425/131.5; 425/192 S; 425/382.2; 425/382.4; 425/463

(58) Field of Classification Search ..... 425/131.5, 425/192 S, 382.2, 382.4, 463
See application file for complete search history.

(56) References Cited

U.S. PATENT DOCUMENTS

| | | | | |
|---|---|---|---|---|
| 2,980,492 | A * | 4/1961 | Jamieson et al. | 264/210.5 |
| 5,227,109 | A | 7/1993 | Allen, III et al. | |
| 5,344,297 | A * | 9/1994 | Hills | 425/131.5 |
| 5,620,644 | A * | 4/1997 | Hodan et al. | 264/169 |
| 6,361,736 | B1 * | 3/2002 | Dugan et al. | 264/172.15 |
| 2002/0094352 | A1 * | 7/2002 | Guo | 425/131.5 |
| 2005/0133948 | A1 | 6/2005 | Cook et al. | |
| 2006/0012072 | A1 * | 1/2006 | Hagewood et al. | 264/176.1 |

FOREIGN PATENT DOCUMENTS

| | | |
|---|---|---|
| EP | 0677600 | 10/1995 |
| GB | 2024096 | 1/1980 |

* cited by examiner

*Primary Examiner* — Yogendra Gupta
*Assistant Examiner* — Joseph Leyson
(74) *Attorney, Agent, or Firm* — BainwoodHuang

(57) ABSTRACT

A device for melt spinning multi-component fibers including at least two melt inlets for introducing separately guided melt components is presented. The device includes a feed plate having a plurality of feed channels for distributing the melt components, a distributor block associated with the feed plate, and a nozzle plate adjoining the distributor block and including a plurality of nozzle bores, wherein the distributor block has several thin distributor plates stacked on top of each other and each have a hole pattern with multiple distribution openings. The thin distributor plates are configured inside the distributor block such that a plurality of melt channels form, which connect the feed channels of the feed plate to the nozzle bores of the nozzle plate. In order to implement high flow volumes, multiple distributor plates having identical hole patterns of the distribution openings are stacked in a tightly sealing manner inside the distributor block.

17 Claims, 4 Drawing Sheets

Figure 1:
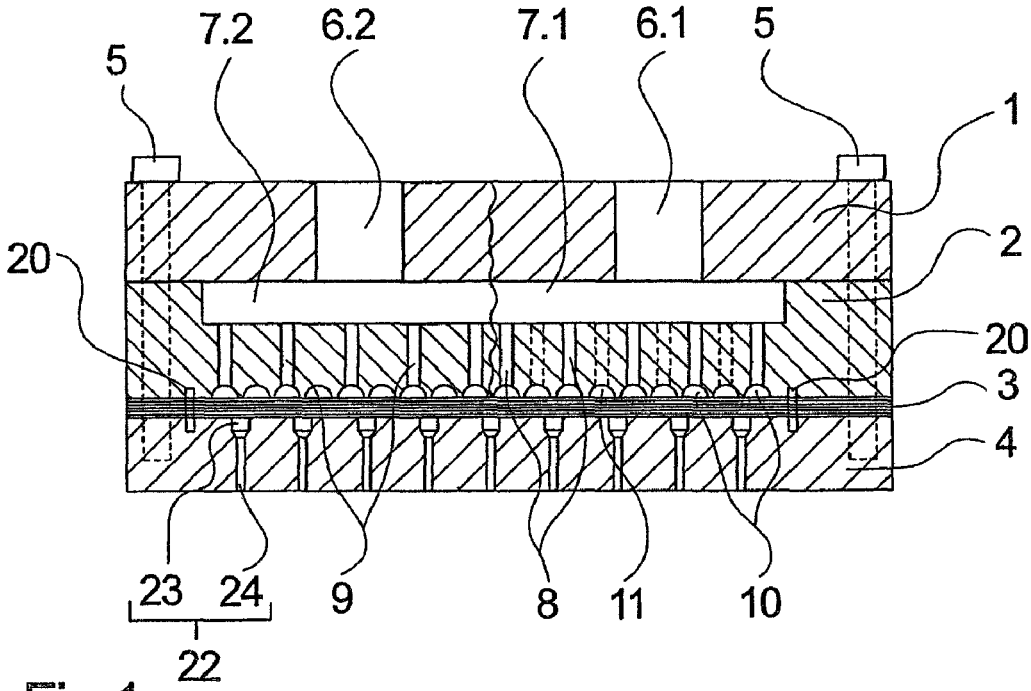

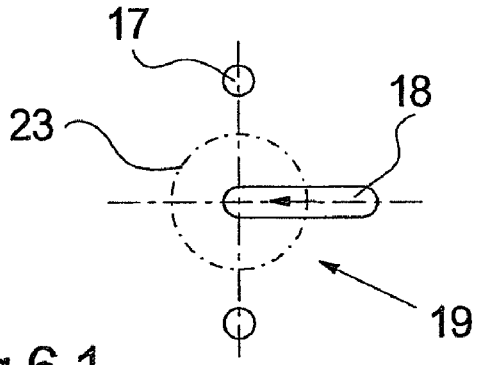
Fig.6.1
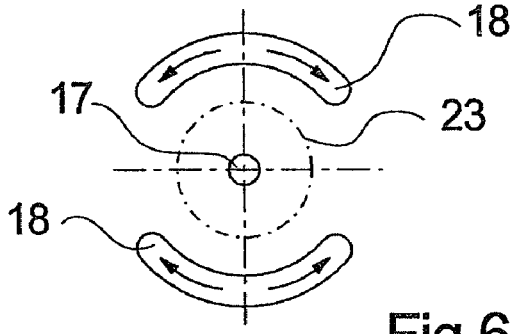
Fig.6.2
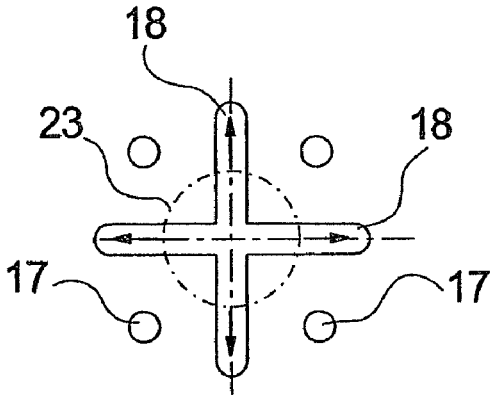
Fig.6.3
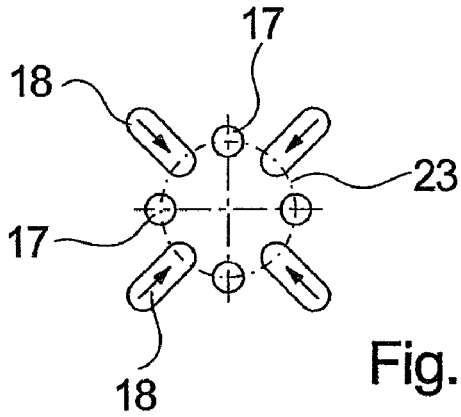
Fig.6.4

DEVICE FOR MELT SPINNING MULTICOMPONENT FIBERS

This patent application is a Continuation of International Patent Application No. PCT/EP2008/055649 filed on May 7, 2008, entitled, "DEVICE FOR MELT SPINNING MULTI-COMPONENT FIBERS", the contents and teachings of which are hereby incorporated by reference in their entirety.

The invention relates to a device for melt spinning multicomponent fibers.

In the melt spinning of multicomponent fibers, two melt components are jointly extruded through a nozzle opening, so that the fiber strand produced through the nozzle opening has a cross section of multiple material components. Thus, for example, bico fibers having a core-sheath structure or a side structure in the cross section may be manufactured from two supplied polymer materials. Such multicomponent fibers are usually extruded in large numbers parallel to one another in order to produce a thread, a tow, or a nonwoven fabric, for example. The melt components must be distributed and respectively supplied to each nozzle bore. To obtain uniform distributions of the melt components over a large number of nozzle bores, in the prior art devices for melt spinning, the multicomponent fibers are preferably used in which the melt components are distributed and supplied to the nozzle bores via a distributor block composed of multiple individual thin distributor plates. Thus, basically two different types of melt spinning devices are known in the prior art.

A device for melt spinning multicomponent fibers is known from EP 0 677 600, in which the distributor block is formed from a plurality of two groups of distributor plates. The distributor plates all have an individual hole pattern of distribution openings which completely penetrate the distributor plates. A first group of distributor plates has grooved distribution openings to allow melt flow in the direction of the plane of the plate. A second group of distributor plates is provided with circular distribution openings in order to conduct a melt flow. The so-called pattern plates of the first group and the so-called boundary plates of the second group are combined with one another in alternation, so that the melt components are alternatingly conducted in the direction of a plane of the plate or transverse to a plane of the plate. The free flow cross sections are specified, in particular in the direction of the plane of the plate, primarily by the thickness of the distributor plates.

The known device has the disadvantage, in the first place, that as the result of the various groups of distributor plates, relatively long melt channels are produced through the distributor block in order to obtain distribution and feed of the melt components. Higher throughputs within the melt channels may be achieved only by means of distributor plates having appropriate thickness. However, the thick-walled distributor plates have the disadvantage that the distribution openings may be provided in the distributor plates only via a highly complex manufacturing process. On the one hand, all of the distribution openings must have cross sections which are as identical as possible in order to achieve a uniform distribution of the melt components. On the other hand, the plates must have a high degree of linearity in order to avoid leaks. In this regard simple and precise production methods are desired, for example the etching of distribution openings. However, this method is suitable only for very thin plates.

Another device for melt spinning multicomponent fibers is known from EP 0 413 688 B1, in which the distributor plates stacked in a distributor block have distribution grooves on their surfaces which cooperate with distribution openings in the distributor plates. Melt flows directed in the plane of the plate are conducted through distribution grooves at the top and bottom sides of the distributor plates. Higher melt throughputs require relatively large groove cross sections, which may be achieved only by very thick distributor plates or by a high percentage of area on the surface of the distributor plates. Due to the relatively large number of nozzle bores per unit surface area, however, separate melt channels per nozzle bore within the distributor block are not achievable for higher melt flows. However, an alternative design of the distribution grooves having a correspondingly greater groove depth results in the above-mentioned production problems.

Thus, the devices for melt spinning known in the prior art are based on distributor blocks for distributing and supplying multiple melt components to the nozzle bores, in which the plate configuration within the distributor block allows only relatively low melt throughputs; i.e., the distributor plates thereof may be implemented only with considerable complexity in manufacturing and resulting penalties with respect to production tolerances. However, higher production tolerances in the manufacture of the distributor plates necessarily result in sealing problems within the distributor block, in which the distributor plates are stacked on top of one another in a sealing manner.

The object of the invention, therefore, is to refine a device for melt spinning multicomponent fibers of the type mentioned at the outset in such a way that a large number of nozzle bores may be uniformly supplied by a distributor block having a plurality of distributor plates, even for relatively high melt throughputs.

A further aim of the invention is to provide a device for melt spinning multicomponent fibers in which the melt channels produced by a plurality of distributor plates in a distributor block allow uniform metering at essentially the same pressure drop.

This object is achieved according to the invention using a device having the features described above.

Advantageous refinements of the invention are defined by the features and feature combinations described below.

The flow cross section of the melt channels produced within the distributor block by the distribution openings in the distributor plates is independent of the particular plate thickness. Thus, the pressure drop required for metering the individual melt flows in the melt channels may be specified solely by the shape of the distribution openings. In addition, relatively high melt throughputs within the distributor block may also be conducted to a plurality of nozzle bores, independent of the thickness of the particular distributor plates. For this purpose, within the distributor block multiple distributor plates having identical hole patterns of the distribution openings are directly stacked in a sealing manner. Thus, even with very thin distributor plates, relatively large flow cross sections may be achieved in the melt channels, in particular in the plane of the plate. Furthermore, thin distributor plates have the particular advantage that the distribution openings may be produced with high manufacturing accuracy, using simple production methods.

In order to uniformly distribute multiple melt components on the individual nozzle bores of a nozzle plate, the refinement of the invention is preferably provided in which the stacked distributor plates having identical hole patterns of the distribution openings form a plate stack, and the distributor block has multiple plate stacks, with different hole patterns of the distribution openings, which are stacked on top of one another. Each of the melt components may thus be conducted by separate melt channels whose free flow cross sections are specified solely by the particular distribution openings.

So that the flow cross sections of the melt channels provided within a plate stack are correspondingly maintained at their top and bottom sides, according to one embodiment it is provided that the distributor plates are held by at least one centering apparatus in such a way that within one of the plate stacks the melt channels thus formed have flow cross sections of equal size.

For a large number of distributor plates within one of the plate stacks, in one embodiment of the invention the distribution openings in the distributor plates situated in the central region of one of the plate stacks have a larger cross section compared to the distribution openings in the outer distributor plates of the plate stack. Thus, for example, tolerance deviations between an upper and a lower distributor plate within the plate stack may be compensated for by the larger distribution openings in the center distributor plate.

In order to minimize the number of distributor plates within the distributor block despite the multiple configuration of the distributor plates having identical hole patterns, the distributor plates of the distributor block each have two types of distribution openings. A first type, as a through opening, conducts a melt flow perpendicular to the plane of the plate, and a second type, as a deflection opening, conducts the melt flow in the plane of the plate, so that within each of the distributor plates melt flows are conducted in the plane of the plate and perpendicular to the plane of the plate. The hole pattern of the distribution opening specifies the position of the through openings and the position of the deflection openings within the distributor plates.

Exact metering and feeding of the melt components to the individual nozzle bores may be advantageously achieved by selecting the configuration of the distributor plates, having different hole patterns of the distribution openings within the distributor block, in such a way that the melt components are separately conducted through the melt channels of the distributor block and to the nozzle bores of the nozzle plate. Thus, one or more melt channels through which the melt components are conducted are associated with each of the nozzle bores.

Identical residence times of the melt components when the individual melt components are fed to the nozzle bores of the nozzle plate may preferably be achieved by the refinement of the invention in which the melt channels within the distributor block have equal lengths between the feed plate and the nozzle plate. In this manner fiber strands may be extruded which have a high degree of uniformity with regard to quality and characteristics of the melt components. The device according to the invention is therefore preferably suited for manufacturing high-quality fiber products.

In order to obtain a sufficient positive pressure for extruding the fiber strands through the nozzle openings, the distributor plates within the distributor block are preferably configured and combined in such a way that the melt channels between the feed channels of the feed plates and the nozzle bores of the nozzle plate cause a pressure drop of <120 bar, preferably <60 bar, in the melt components. Thus, sufficient extrusion pressures are ensured at the customary feed pressures of the melt components of greater than 200 bar.

By the selection of the hole patterns within the distributor plates, as well as the configuration and combination of the distributor plates, associations with the melt channels may be achieved so that each of the nozzle bores extrudes a fiber having, for example, a core-sheath cross section or a fiber having a side-side cross section. In this regard the device according to the invention is very flexible in use for extrusion of multicomponent fibers.

In order to design in particular the production of the distribution openings within the distributor plates to be as simple as possible, according to one advantageous refinement it is provided that the distributor plates are composed of a metal having, for example, a material thickness of <1 mm, preferably <0.5 mm, whereby the distribution openings may be provided in the distributor plates by etching. Thus, only one work step is necessary to provide a continuous distribution opening in the distributor plate by etching.

In order to achieve a high density of the distributor openings within the distributor plates on the one hand, and to allow the distribution openings to be produced on the other hand, according to one advantageous refinement of the invention the through openings in the distributor plates are formed by circular holes having a diameter of at least one times the material thickness of the distributor plate.

The deflection openings in the distributor plates are preferably formed by grooves having a width of at least one times the material thickness of the distributor plates.

The metal of the distributor plates and the materials of the feed plate and of the nozzle plate are preferably selected in such a way that all of the plates have essentially the same thermal expansion. In this manner the sealing gap formed between the individual plates may be reliably controlled, even at elevated temperatures, without leaks occurring. In addition, material stresses between the plates are avoided.

The embodiment of the device according to the invention is preferably used in which the feed plate, the distributor plates of the distributor block, and the nozzle plate are held together in a self-sealing manner. Additional sealants are not required.

Figure 2:
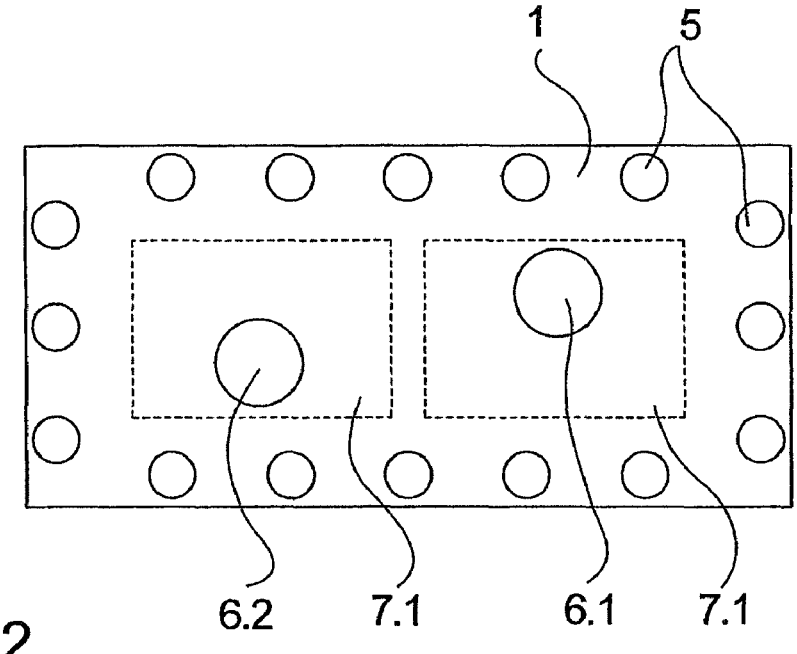
Figure 3:
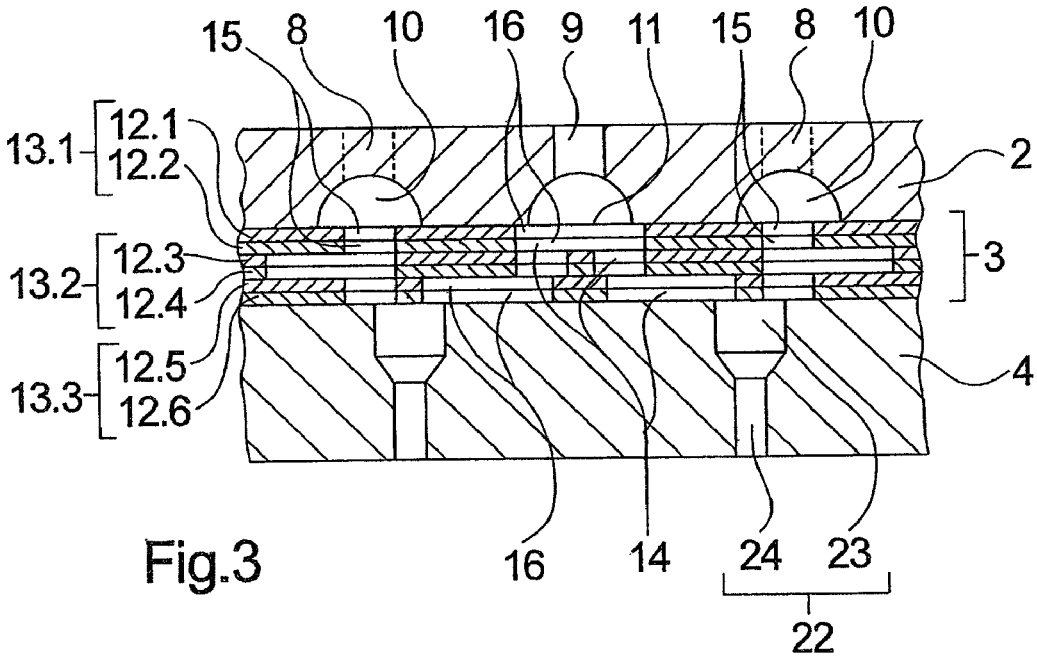
Figure 4:
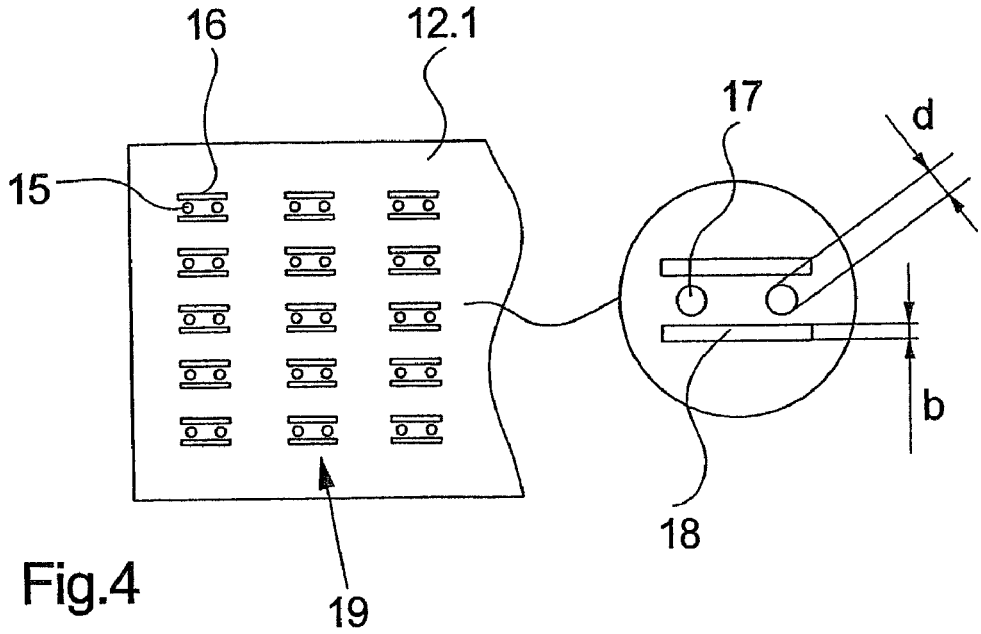
Figure 5:
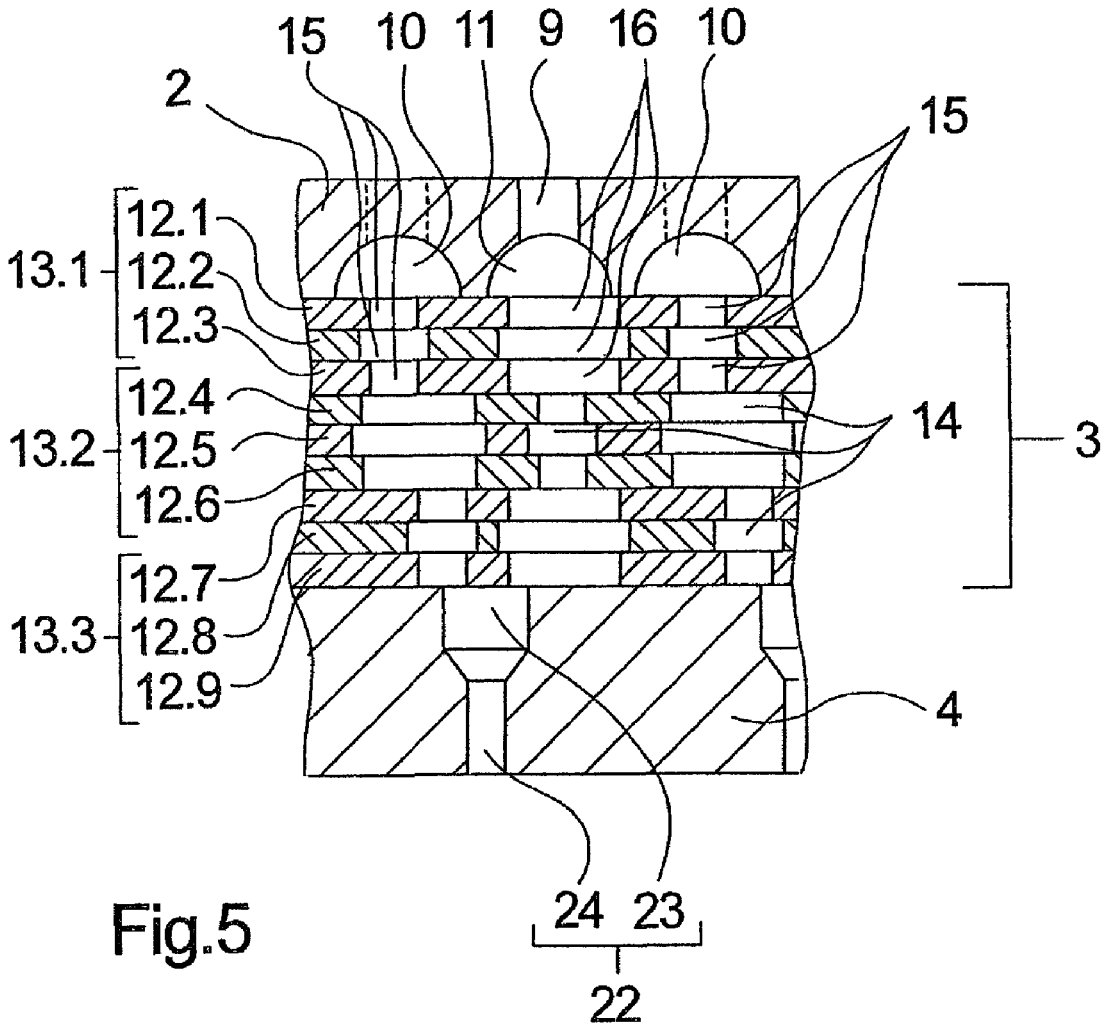

The device according to the invention is described in greater detail below on the basis of several embodiments, with reference to the accompanying figures which show the following:

FIG. 1 schematically shows a cross-sectional view of a first embodiment of the device according to the invention;

FIG. 2 schematically shows a top view of the embodiment from FIG. 1;

FIG. 3 schematically shows a detail of the cross-sectional view of the embodiment from FIG. 1;

FIG. 4 schematically shows a top view of one embodiment of a distributor plate;

FIG. 5 schematically shows a partial view of a further embodiment of the device according to the invention; and FIGS. 6.1, 6.2, 6.3, and 6.4 schematically show several examples of a hole pattern of a distributor plate.

FIGS. 1 and 2 schematically illustrate several views of a first embodiment. In FIG. 1 the device is shown in a cross-sectional view, and in FIG. 2, in a top view. The following description applies to both figures unless explicit reference is made to one of the figures.

The embodiment according to FIGS. 1 and 2 has a plate design formed by joining together multiple rectangular plates. Thus, an upper connecting plate 1 is provided which has two melt inlets 6.1 and 6.2. During operation the melt inlets 6.1 and 6.2 are each connected via melt lines to two separate melt sources to allow two melt components to be separately supplied to the device.

The connecting plate 1 is adjoined by a feed plate 2, which at a top side has a feed chamber 7.1 and 7.2 for melt inlets 6.1 and 6.2, respectively. Feed chambers 7.1 and 7.2 are connected to the underside of the feed plate 2 via multiple melt channels. In the present exemplary embodiment, the melt channels are formed by a plurality of feed grooves 10 and 11 and a plurality of feed bores 8 and 9. At one end the feed bores 8 open into the feed chamber 7.1, and at the opposite end open into the feed grooves 10. At one end the feed bores 9 open into the feed chamber 7.2, and at the opposite end open into the feed grooves 11. Feed grooves 10 and feed grooves 11 are situated next to one another in parallel at the bottom side of the feed plate 2, and extend over the entire functional area of the feed plate 2.

In the cross section illustrated in FIG. 1, the melt inlets 6.1 and 6.2 of the connecting plate 1 are offset with respect to one another, and the offset feed chambers 7.1 and 7.2 of the feed plate are shown next to one another. The offset is made clear by a broken line illustrated in the central region of the connecting plate 1 and the feed plate 2.

As shown in FIG. 1, the bottom side is adjoined by a distributor block 3 which is formed from a plurality of distributor plates. The design and function of the distributor block 3 are explained in greater detail below.

The distributor block 3 is adjoined by a nozzle plate 4 having a plurality of uniformly distributed nozzle bores 22 within its functional area. The nozzle bores 22 are preferably aligned in a row, each nozzle bore 22 preferably opening into the bottom side of the nozzle plate via a capillary section 24. At the top side of the nozzle plate 4 an inlet section 23 of the nozzle bores 22 is provided which opens into a bottom side of the distributor block 3.

As shown in FIGS. 1 and 2, at the outer edge of the connecting plate 1 multiple connecting devices 5 are provided which join the connecting plate 1, the feed plate 2, the distributor block 3, and the nozzle plate 4 together in such a way that the sealing gaps which form between the respective plates 1 through 4 are held together in a sealing manner so that no leaks to the outside, or internal leaks resulting in intermixing of the melt components, can occur.

For an explanation of the distributor block 3 situated between the feed plate 2 and the nozzle plate 4, reference is also made to FIG. 3. FIG. 3 shows a detail of the cross-sectional view in the region of the distributor block 3. The feed plate 2 is located at the top side of the distributor block 3. Feed grooves 10 and 11, provided next to one another on the bottom side, open with their open groove ends directly onto a top side of the distributor block 3. The distributor block 3 is formed by a plurality of distributor plates 12.1 through 12.6. The number of distributor plates is by way of example. Each of the distributor plates 12.1 through 12.6 contains a plurality of distribution openings 14 which completely penetrate the distributor plates from a top side to a bottom side. In order to form melt channels within the distributor block 3 via the distribution openings 14 in the distributor plates 12.1 through 12.6 for connecting the top side to the bottom side of the distributor block 3, the distribution openings 14 are provided in certain specified hole patterns in distributor plates 12.1 through 12.6. The hole patterns of distributor plates 12.1 through 12.6 each include two types of distribution openings 14. A first type of the distribution openings 14 is formed by through openings 15 which only allow the melt flow to be conducted transverse to a plane of the plate. A second type of the distribution openings is formed by deflection openings 16 which allow the melt flow to be conducted in the direction of the plane of the plate. By the selection of the hole patterns and their mutual association, numerous melt channels may thus be formed within the distributor block 3, each allowing the nozzle bores to be supplied with the two melt components at the bottom side of the distributor block.

In the embodiment illustrated in FIG. 3, the first two distributor plates 12.1 and 12.2 have an identical hole pattern of the distribution opening. In the illustrated detail view, distributor plates 12.1 and 12.2 have a central deflection opening 16 and two outer through openings 15. Distributor plates 12.1 and 12.2 thus form a plate stack 13.1 having identical hole patterns. The free flow cross sections are essentially formed by the geometric shape of the through openings 15 and of the deflection openings 16. In particular, the pressure buildup of the melt flow directed in the plane of the plate may thus be adjusted independently of the particular material thickness of the distributor plate. Thus, a groove width of the deflection openings 16 may be utilized to obtain the required pressure buildup in the melt channel thus formed. Higher melt throughputs may also be achieved due to the multiple superposed stacked configuration of distributor plates 12.1 and 12.2 within plate stack 13.1. The groove depths may be increased as desired, at identical groove widths, by the selection of the number of distributor plates.

Distributor plates 12.3 and 12.4 which follow distributor plates 12.1 and 12.2 likewise have a plate stack 13.2 with identical hole patterns. Thus, distributor plates 12.3 and 12.4 each have two central through openings 15 which are situated corresponding to the deflection opening 16 in the distributor plate 12.2. Two further deflection openings 16 in distributor plates 12.3 and 12.4 are provided corresponding to the through openings 15 in distributor plate 12.2.

Distributor plate 12.4 is adjoined by two further distributor plates 12.5 and 12.6 having identical hole patterns. The hole pattern of the distribution openings in distributor plates 12.5 and 12.6 is designed in such a way that one through opening 15 and one deflection opening 16 jointly open into an inlet section 23 of a nozzle bore 22. Distributor plates 12.5 and 12.6 thus form a further plate stack, so that the distributor block as a whole is formed by the three plate stacks 13.1 through 13.3. Each of plate stacks 13.1 through 13.3 contains multiple distributor plates having identical hole patterns of the distribution openings. Thus, in the detail illustrated in FIG. 3 a total of four melt channels are formed which connect the feed grooves 10 and 11 to the two nozzle bores 22. The central melt channels are jointly fed from a deflection opening 16 in distributor plate 12.2, which directly receives the melt component from the feed groove 11. Each of the outer melt channels conducts the other melt components from the feed groove 10 into the nozzle bores 22. Thus, a multicomponent fiber whose fiber cross section has a side-side structure may be extruded in each of the nozzle bores 22.

In order to achieve inlet and outlet cross sections of the melt channels within plate stacks 13.1 through 13.3 which are as uniform as possible, distributor plates 12.1 through 12.6 are fixed in position relative to one another within the distributor block 3 by centering apparatus. As illustrated in FIG. 1, the centering apparatus may be implemented by centering pins 20, for example.

In the embodiment illustrated in FIG. 1, distributor plates 12.1 through 12.6 are composed of a metal having a material thickness of <0.5 mm. The distribution openings 14 in the distributor plates are produced using an etching process, so that any desired hole patterns of distribution openings may be produced in distributor plates 12.1 through 12.6. The metal of distributor plates 12.1 through 12.6 is essentially identical to the material of the feed plate 2 or nozzle plate 4 with regard to thermal expansion, so that no relevant mutual material stresses occur, even at elevated operating temperatures above 200° C. In this regard, the plates illustrated in FIG. 1 may be stacked directly on top of one another in a sealing manner without additional sealant. The respective top and bottom sides of plates 1 through 4, and the top and bottom sides of distributor plates 12.1 through 12.6 in distributor block 3, are thus held together in a self-sealing manner. The melt channels provided for supplying the nozzle bores 22 in the distributor block 3 have equal lengths, thus ensuring identical residence times of the melt components during the distribution.

To allow the greatest possible number of nozzle bores to be supplied through individual melt channels within the distributor block, the distribution openings 14 are preferably aligned in a row as a hole pattern. FIG. 4 shows the top view of a distributor plate 12.1 as it might be used, for example, in a device according to the invention. A plurality of through openings 15 and deflection openings 16 are symmetrically arranged next to one another in multiple rows. The through openings 15 are designed as circular holes 17 having a diameter d. The ratio of the diameter d of the circular holes 17 to a material thickness of the distributor plate 12.1 is at least 1.0× the material thickness in order to allow production of the circular hole 17 in the distributor plate 12.1, using an etching process.

The deflection openings 16 provided in the distributor plate 12.1 are formed by grooves 18 which with their groove width b completely penetrate the distributor plate 12.1. In addition, the groove width b is designed to be greater than the material thickness of the distributor plate 12.1 by a factor of 1.0. The position of the deflection openings 16 and the position of the through openings 15 relative to one another are defined by the hole pattern 19. Thus, using such distributor plates it is possible to uniformly supply both melt components to corresponding row configurations of nozzle bores in the nozzle plate.

To obtain the most accurate metering possible of the melt components to each of the nozzle bores, the device according to the invention is preferably designed according to the exemplary embodiment in FIG. 5. The exemplary embodiment according to FIG. 5 is shown only in a detail view of the distributor block 3 with the adjacent feed plate 2 and nozzle plate 4. Only the design of the distributor block 3 differs from the previously described exemplary embodiment according to FIGS. 1 and 2. In this regard, reference is made to the previous description, and only the differences are discussed.

In the embodiment of the device according to the invention illustrated in FIG. 5, the distributor block 3 is formed by a total of three plate stacks 13.1 through 13.3, each including three distributor plates 12.1 through 12.9. Thus, plate stack 13.1 is formed by distributor plates 12.1 through 12.3, plate stack 13.2 is formed by distributor plates 12.4 through 12.6, and plate stack 13.3 is formed by distributor plates 12.7 through 12.9. The distributor plates have identical hole patterns of the distribution openings 14 within plate stacks 13.1 through 13.3. Each of distributor plates 12.1 through 12.9 has a plurality of through openings 15 and deflection openings 16 which are stacked in a given pattern arrangement with respect to one another. To obtain identical inlet and outlet cross sections for the melt channels within the top and plate bottom sides of stacks 13.1 and 13.3, the through openings 15 and the deflection openings 16 of the outer distributor plates 12.1 and 12.3 for plate stack 13.1 have identical sizes. However, the central distributor plate 12.2, with the identical hole pattern, has slightly larger through openings 15 and deflection openings 16, so that position deviations between the upper distributor plate 12.1 and the lower distributor plate 12.2 do not affect the free flow cross section of the melt channel formed by the plate stack 13.1.

Plate stacks 13.2 and 13.3 have an analogous design, so that central distributor plates 12.5 and 12.8 each have larger through openings 15 and deflection openings 16 compared to the adjacent outer distributor plates.

In the embodiment illustrated in FIG. 5, two melt channels are formed by distributor plates 12.1 through 12.9 between feed grooves 10 and 11 and nozzle bore 22. Thus, each melt component is supplied to the nozzle bores 22 of the nozzle plate via separate nozzle channels.

The configuration and combination of distributor plates 12.1 through 12.9 are preferably selected in such a way that the melt channels between feed grooves 10 and 11 and the nozzle bore 22 cause the smallest possible pressure drop. Thus, the melt components may be passed through the distributor block 3 at a pressure drop of <60 bar, thus maintaining a high extrusion energy for extruding the fiber strands. However, pressure drops of <120 bar in the melt components are still sufficient to extrude fiber cross sections having a side structure or fiber cross sections having a core-sheath structure.

FIGS. 6.1 through 6.4 schematically illustrate several examples of a hole pattern in a distributor plate which might be used, for example, in a distributor block in the previously described exemplary embodiments according to FIG. 1, FIG. 3, or FIG. 5. The hole patterns illustrated in FIGS. 6.1 through 6.4 are shown with reference to a nozzle bore of a nozzle plate, the inlet section 23 of the nozzle bore associated in each case with the hole patterns being shown in dashed lines.

Each of the hole patterns shown in FIGS. 6.1 through 6.4 is specified by a combination of through openings and deflection openings. The deflection openings are designed as oblong grooves 18, each of which conducts a melt flow in the plane of the plate. The through openings are designed as circular holes 17 which conduct a melt flow perpendicular to the plane of the distributor plate.

In the examples of the hole patterns 19 illustrated in FIGS. 6.1 through 6.4, the numbers and positions of the circular holes 17 and of the grooves 18 are different, depending on the distribution. The hole patterns illustrated in FIGS. 6.1 through 6.3 are suitable in particular for conducting the melt components on the feed side and in the central region of the distributor block. The hole pattern illustrated in FIG. 6.4 is particularly suitable for introducing two melt components into a nozzle bore. In the configuration of the circular holes 17 and grooves 18 illustrated in FIG. 6.4, a segmented distribution of the melt components within the extruded filament would result.

The hole patterns illustrated in FIGS. 6.1 through 6.4 could be combined into one distributor block. First, a first plate stack composed of multiple distributor plates is formed which has the hole pattern illustrated in FIG. 6.1. This plate stack would be situated directly at the bottom side of a feed plate. The first plate stack would then be followed by a second plate stack having the hole pattern according to FIG. 6.2. The melt components would then be further distributed via two further plate stacks having the hole patterns according to FIGS. 6.3 and 6.4.

Thus, all common fiber cross sections in the extrusion of filaments may be produced by the selection and configuration of the hole patterns in the distributor plates. So-called core-sheath or "island in the sea" structures may also be obtained.

The embodiments illustrated in FIGS. 1 through 5 of the device according to the invention for melt spinning multicomponent fibers may be advantageously used for all known processes, regardless of whether the individual extruded fibers after cooling are made into a thread or a laid nonwoven fabric. Thus, such devices may be used in the manufacture of nonwoven fabric to easily achieve larger working widths in the range of 7 m and greater.

The shape of the nozzle plate selected in the embodiment is likewise by way of example. In principle, elliptical, circular, or other plate shapes may also be combined in this manner.

LIST OF REFERENCE NUMERALS

1 Connecting plate
2 Feed plate

3 Distributor block
4 Nozzle plate
5 Connecting device
6.1, 6.2 Melt inlet
7.1, 7.2 Feed chamber
8 Feed bore
9 Feed bore
10 Feed groove
11 Feed groove
12.1-12.9 Distributor plates
13.1-13.3 Plate stacks
14 Distribution openings
15 Through opening
16 Deflection opening
17 Circular hole
18 Grooves
19 Hole pattern
20 Centering pin
22 Nozzle bore
23 Inlet section
24 Capillary section

What is claimed is:

1. Device for melt spinning multicomponent fibers, comprising at least two melt inlets for introducing separately conducted melt components, having a feed plate with a plurality of feed channels for distributing the melt components, a distributor block associated with the feed plate, and a nozzle plate adjoining the distributor block and having a plurality of nozzle bores, the distributor block having multiple thin distributor plates stacked on top of one another, and each having a hole pattern of multiple distribution openings, and the thin distributor plates jointly forming a plurality of melt channels which connect the feed channels of the feed plate to the nozzle bores of the nozzle plate, multiple distributor plates having identical hole patterns of the distributor openings are directly stacked in a sealing manner within the distributor block.

2. Device according to claim 1, wherein the stacked distributor plates having identical hole patterns of the distribution openings form a plate stack, and the distributor block has multiple plate stacks, with different hole patterns of the distribution openings, which are stacked on top of one another.

3. Device according to claim 1, wherein the distributor plates are held by at least one centering means in such a way that within one of the plate stacks the melt channels thus formed have flow cross sections of equal size.

4. Device according to claim 1, wherein the distribution openings in the distributor plates situated in the central region of one of the plate stacks have a larger cross section compared to the distribution openings in the outer distributor plates of the plate stack.

5. Device according to claim 1, wherein the distributor plates of the distributor block each have two types of distribution openings: a first type, as a through opening, which conducts a melt flow perpendicular to the plane of the plate, and a second type, as a deflection opening, which conducts a melt flow in the plane of the plate, and the hole pattern of the distribution openings specifies the position of the through openings and the position of the deflection openings within the distributor plates.

6. Device according to claim 5, wherein the configuration of the distributor plates, having different hole patterns of the distribution openings within the distributor block, is selected in such a way that the melt components are separately conducted through the melt channels of the distributor block and to the nozzle bores of the nozzle plate.

7. Device according to claim 1, wherein the melt channels within the distributor block have equal lengths between the feed plate and the nozzle plate.

8. Device according to claim 1, wherein the configuration and combination of the distributor plates in the distributor block are selected in such a way that the melt channels between the feed channels and the nozzle bores cause a pressure drop of <120 bar in the melt components.

9. Device according to claim 1, wherein the hole pattern of the last distributor plate of the distributor block in front of the nozzle plate is designed in such a way that a fiber having a core-sheath cross section or a fiber having a side-side cross section may be extruded through each of the nozzle bores.

10. Device according to claim 1, wherein the distributor plates are composed of a metal having a material thickness less than 1 mm, and the distribution openings may be provided in the distributor plates by etching.

11. Device according to claim 10, wherein the metal of the distributor plates and the material of the feed plate and of the nozzle plate are selected in such a way that all of the plates have essentially the same thermal expansion.

12. Device according to claim 5, wherein the through openings in the distributor plates are formed by circular holes having a diameter of at least 1.0 times a material thickness of the distributor plate.

13. Device according to claim 5, wherein the deflection openings in the distributor plates are formed by grooves having a groove width of at least 1.0 times the material thickness of the distributor plates.

14. Device according to claim 1, wherein the feed plate, the distributor plates of the distributor block, and the nozzle plate are held together in a self-sealing manner.

15. Device according to claim 8, wherein the melt channels between the feed channels and the nozzle bores cause a pressure drop of <60 bar in the melt components.

16. Device according to claim 10, wherein the distributor plates are composed of a metal having a material thickness less than 0.5 mm.

17. Device according to claim 16, wherein the metal of the distributor plates and the material of the feed plate and of the nozzle plate are selected in such a way that all of the plates have essentially the same thermal expansion.

* * * * *